US005538074A

United States Patent [19]

Meyer

[11] Patent Number: 5,538,074

[45] Date of Patent: Jul. 23, 1996

[54] HEAT EXCHANGER, IN PARTICULAR COOLING APPARATUS

[76] Inventor: Friedhelm Meyer, Hof Geisenberg 1, D-57319, Bad Berleburg, Germany

[21] Appl. No.: 238,420

[22] Filed: May 5, 1994

[30] Foreign Application Priority Data

May 10, 1993 [DE] Germany ..... 43 15 538.3

[51] Int. Cl.[6] ..... F25D 17/06; F28F 13/06

[52] U.S. Cl. ..... 165/40; 165/96; 165/122; 137/846; 415/211.2; 454/259

[58] Field of Search ..... 165/122, 127, 165/96, 40; 415/211.2, 220, 226; 454/259, 347; 137/846

[56] References Cited

U.S. PATENT DOCUMENTS

| | | | |
|---|---|---|---|
| 1,874,043 | 8/1932 | Ilg et al. | 454/259 |
| 2,279,425 | 4/1992 | Voysey | 415/146 |
| 2,354,128 | 7/1994 | Lake | 415/143 |
| 2,741,972 | 4/1956 | Pryne | 454/347 X |
| 3,120,167 | 2/1964 | Kearny | 454/259 X |
| 3,305,006 | 2/1967 | Daltry | 165/124 |
| 4,131,060 | 12/1978 | Caine | 454/351 |
| 4,207,025 | 6/1980 | Reynolds et al. | 415/200 |
| 4,449,549 | 5/1984 | Weck | 454/259 X |
| 4,593,504 | 6/1986 | Bonnici et al. | 454/347 X |
| 5,230,657 | 7/1993 | Opoka | 454/259 X |

*Primary Examiner*—Leonard R. Leo
*Attorney, Agent, or Firm*—Austin R. Miller

[57] ABSTRACT

In the case of a heat exchanger, in particular a cooling apparatus, having a housing and at least one ventilator for blowing the air which flows through the heat exchanger out through an outlet opening in the housing, there is arranged on the outside of the outlet opening (4) of the housing (1), in order to avoid energy losses upon defrosting and to save energy costs, a flexible flat piece (6, 15) which permits air to emerge unimpeded into the surrounding space when the ventilator is operating but which collapses when the ventilator is shut off and thereby covers the outlet opening of the housing so that, upon the defrosting, no moist and warm defrosting air can emerge through the outlet opening of the housing into the surrounding space.

3 Claims, 6 Drawing Sheets

HEAT EXCHANGER, IN PARTICULAR COOLING APPARATUS

The present invention relates to a heat exchanger, in particular a cooling apparatus, such as an air cooler having a housing and at least one ventilator for blowing the air which flows through the heat exchanger out through an outlet opening in the housing, It is known from U.S. Pat. No. 2,279,425 to provide the outlet opening of the housing of a blower with a lamellar covering device, the individual lamellae consisting of rigid material and being mounted swingably so that upon operation of the blower they are swung by the dynamic pressure into an open position while they are swung back into the closed position by the action of a spring when the blower is disconnected.

In the case of air coolers such as are used in refrigerating and deep-freeze plants, air is drawn in and blown into the surrounding space by one or more ventilators through the air cooler which represents a heat exchanger, the air cooler taking up heat from the air fed and thus cooling it. When the surface of the air cooler drops below the dew point at temperatures less than/equal to +/− 0° C., the efficiency-of the air cooler decreases with increasing formation of hoarfrost and ice.

As a rule, a defrosting of the air cooler is initiated as required. During such a defrosting process, the heat exchanger is heated by electrical heating or by hot gas, the formation of hoarfrost and ice being eliminated by defrosting. During the defrosting, the ventilator is disconnected.

During the defrosting, moist and warm defrosting air flows through the open air outlet opening of the housing into the surrounding space. This produces, on the one hand, a loss of energy due to the fact that the heat, which is required in the heat exchanger for the defrosting, emerges into the surrounding space and, on the other hand, due to the fact that the surrounding space, which is to be kept cool, is heated. The moist and warm defrosting air impairs the quality of the refrigerated material and also the insulations of refrigerating and deep freeze places by the formation of condensate and subsequent formation of hoarfrost and ice. After the defrosting, the moist and warm air must be taken up again and cooled which immediately causes a new formation of hoarfrost and ice on the air cooler and at the same time prolongs the cooling necessary to achieve the desired temperature of the refrigeration place. This results in energy losses of the defrosting heat of frequently more than 50% and there also result, on the whole, high energy costs.

If the outlet opening in a cooling apparatus is to be covered by a mechanical covering device, such as described in U.S. Pat. No. 2,279,425, then a considerable expense results for said mechanical covering device and there is constantly the danger that the mechanism freezes.

It is the object of the present invention to develop a heat exchanger of the type indicated above with simple means in such a way that energy losses upon defrosting can be substantially reduced and overall energy costs can be saved.

This object is solved in accordance with the invention in the manner that there is attached to the air outlet opening of the housing a flexible flat piece or a flexible piece of tubing of fabric or plastic sheeting which, when the ventilator is operating, aligns itself in the direction of flow of the air and allows the air to emerge into the surrounding space while it collapses and thus covers the outlet opening of the housing when the ventilator is disconnected so that upon defrosting no moist and warm defrosting air can emerge into the surrounding space through the outlet opening of the housing.

In this way, the defrosting can be carried out with considerably less energy and there are also incurred lower energy costs as a whole due to the fact that the desired temperature is reached more quickly upon the subsequent cooling.

If several air coolers are provided in larger rooms, then the embodiment in accordance with the invention is also advantageous in that secondary air currents can no longer affect the defrosting of an air cooler if one of several air coolers is disconnected for defrosting while adjacent air coolers continue to operate. The secondary air currents from the still operating air coolers blow the moist and warm defrosting air from the air cooler which is being defrosted into the room so that the moisture and heat load is increased for the air coolers still operating in the cooling mode. In the case of several air coolers in one room, this has the result that the air cooler to be defrosted is frequently not defrosted completely. In any event, the defrosting process takes a long period of time and it causes high energy costs for the entire cooling plant. This is also avoided by the embodiment in accordance with the invention.

Embodiments of the invention indicated by way of example will be explained further below with reference to the drawing, in which FIG. 1 is a front and side view of two adjacent air coolers having, in each case, two ventilators;

Figure 1:
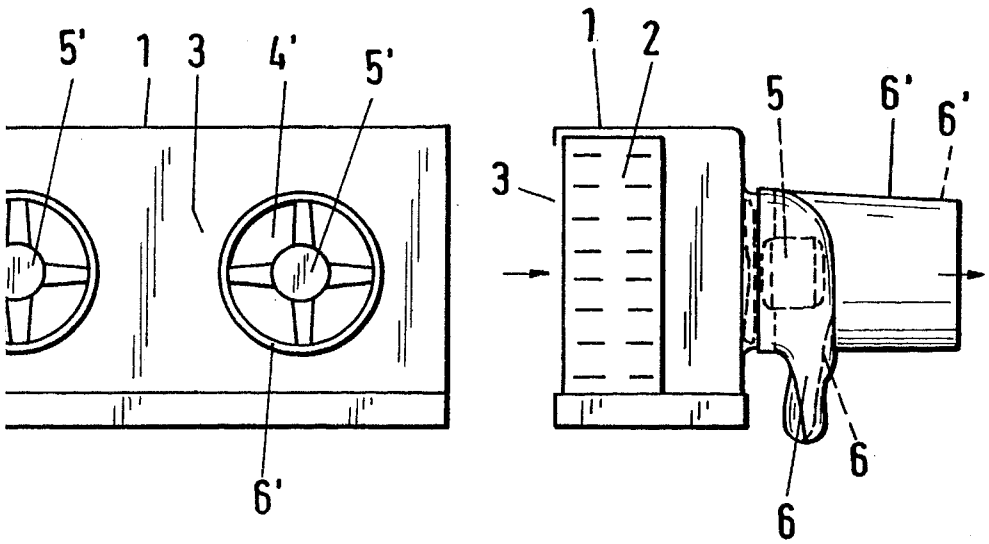

In the figures, 1 designates the housing of an air cooler, condenser or similar heat exchanger which surrounds a heat exchange bundle 2 of pipes through which the coolant flows and which are provided with cooling ribs. In FIG. 1, the air inlet side 3 of the two housings 1, ,1' for the flowing in of ambient air is open while the outlet side of the housing 1, 1' is closed and provided, in the embodiment shown in FIG. 1, with in each case two spaced-apart round outlet openings 4, 4'. In the outlet openings 4, 4' there is arranged in each case one ventilator 5 and 5', respectively. This construction is known per se.

As shown in FIG. 1, a flexible piece of tubing 6 or 6' is attached on the outside of each outlet opening 4, 4', the pieces of tubing 6 shown in FIG. 1 assuming a tubular shape due to the air blown out by the operating ventilators 5 while the pieces of tubing 6' collapse when the ventilators 5' are disconnected and thus cover the outlet openings 4'.

If defrosting is effected on the heat exchanger 2 of the left air cooler when the ventilators 5' are disconnected, then the defrosting heat cannot escape through the covered outlet opening 4'. A secondary air current through the operating adjacent ventilator 5 of the right air cooler is prevented by the collapsed pieces of tubing 6' which cover the outlet openings 4'.

In the embodiment according to FIG. 2, a rigid hood 7 is arranged on the air inlet side 3 of the housing 1, said hood covering the inlet side of the housing and permitting access of air only from below, in which connection the air flow is deflected by 90° into the heat exchanger 2 by the shape of the hood. This embodiment has the advantage that, upon the defrosting of the heat exchanger 2, no moist and warm defrosting air emerges on the air inlet side from the housing and rises upward. Possibly emerging defrosting air is captured by the hood 7 and held therein until a new cooling process commences.

Figure 2:
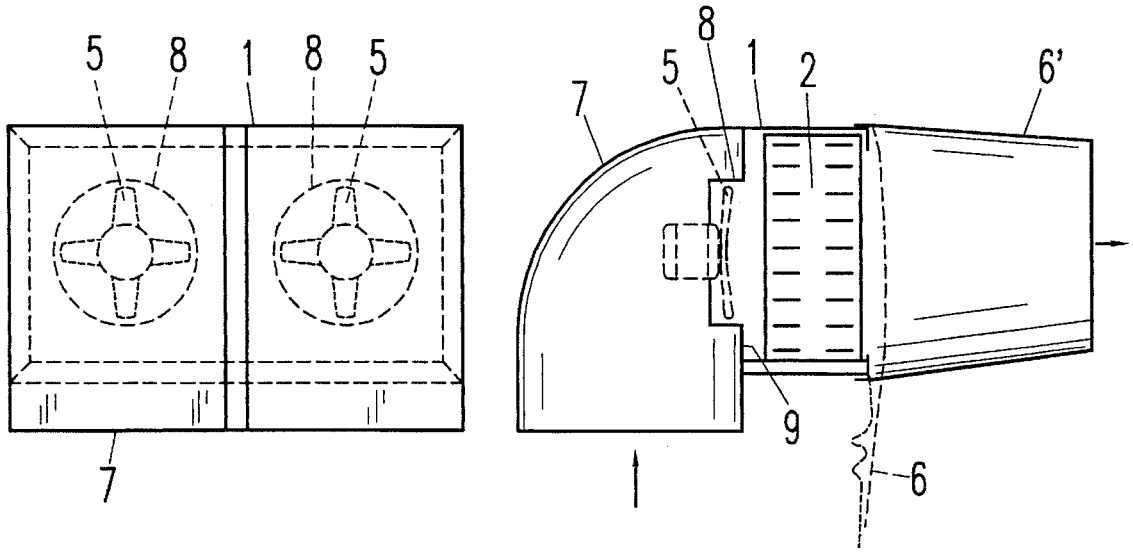
FIG. 2 shows, in one front view and one side view, a further embodiment of an air cooler having two ventilators.

In the embodiment according to FIG. 2, blowing ventilators 5, 5' are arranged on the air inlet side of the housing in a corresponding round opening 8, 8' of the hood wall 9 which covers the air inlet side, while the air outlet side is uncovered over the cross section of the heat exchanger 2. Two pieces of tubing 6, 6' are attached alongside each other on the air outlet side, said pieces of tubing extending over the uncovered cross section of the air outlet side, the piece of tubing 6 being shown by dashed lines in the covering position. In the case of blowing ventilators, there can also be provided an individual piece of tubing 6 which surrounds the entire outlet side and which collapses upon elimination of the dynamic pressure caused by the ventilators and covers the outlet opening as shown by dashed lines in FIG. 2. On the air inlet side, the vertically arranged hood wall 9 prevents the moist and warm defrosting air from emerging from the housing 1. The defrosting air which emerges through the opening 8 in which the ventilator 5 is arranged is captured in the hood 7, which is closed off on top and on the sides, so that it does not escape into the surrounding air.

Such a rigid hood 7 which is closed on top and on the sides is also advantageous in the case of the embodiment according to FIG. 1 having exhaust ventilators since the defrosting air escaping on the air inlet side is captured also in the case of this embodiment. While in the case of the embodiment according to FIG. 1, the piece of tubing 6, 6' has a circular basic cross section, there can also be provided pieces of tubing having a rectangular, square or oval cross section.

In the case of the embodiment according to FIG. 2, a partition wall is provided in the hood 7, which partition separates the air inlet area of the one ventilator from that of the other ventilator so that no secondary air currents occur on the air inlet side when one of the ventilators has stopped to operate while the other continues to operate.

Figure 3:
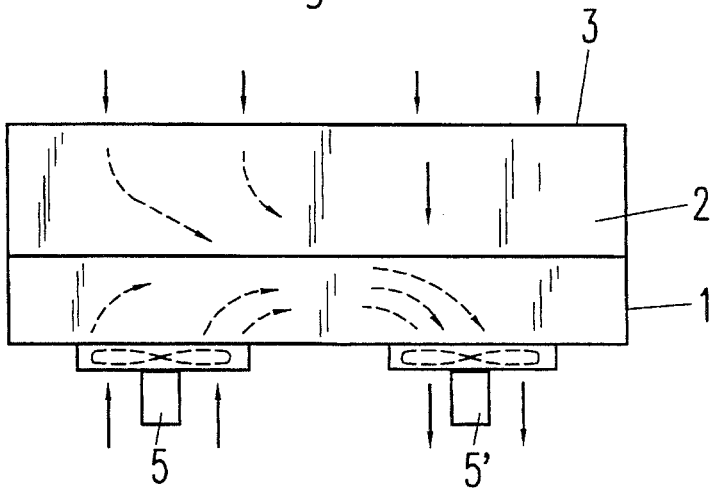
FIG. 3 is a top view of an air cooler having two adjacent ventilators in accordance with the prior art.

FIG. 3 is a top view of an air cooler having two ventilators 5, 5' according to the prior art, the air flow being indicated by arrows when the ventilator 5 has stopped operating and only the ventilator 5' still continues to operate. In this case, air is drawn in through the air outlet opening 4 of the stopped ventilator 5 in the manner of a short circuit by the operating ventilator 5' which considerably reduces the refrigerating capacity. On the other hand, if in each case one piece of tubing 6, 6' is arranged on the two air outlet openings, as shown in FIGS. 1 and 2, then the piece of tubing on the non-operating ventilator 5 collapses and closes off the air outlet opening 4 so that the secondary air flow 14 indicated in FIG. 3 cannot occur and the entire air drawn in by the ventilator 5' flows through the heat exchanger 2.

Figure 4:
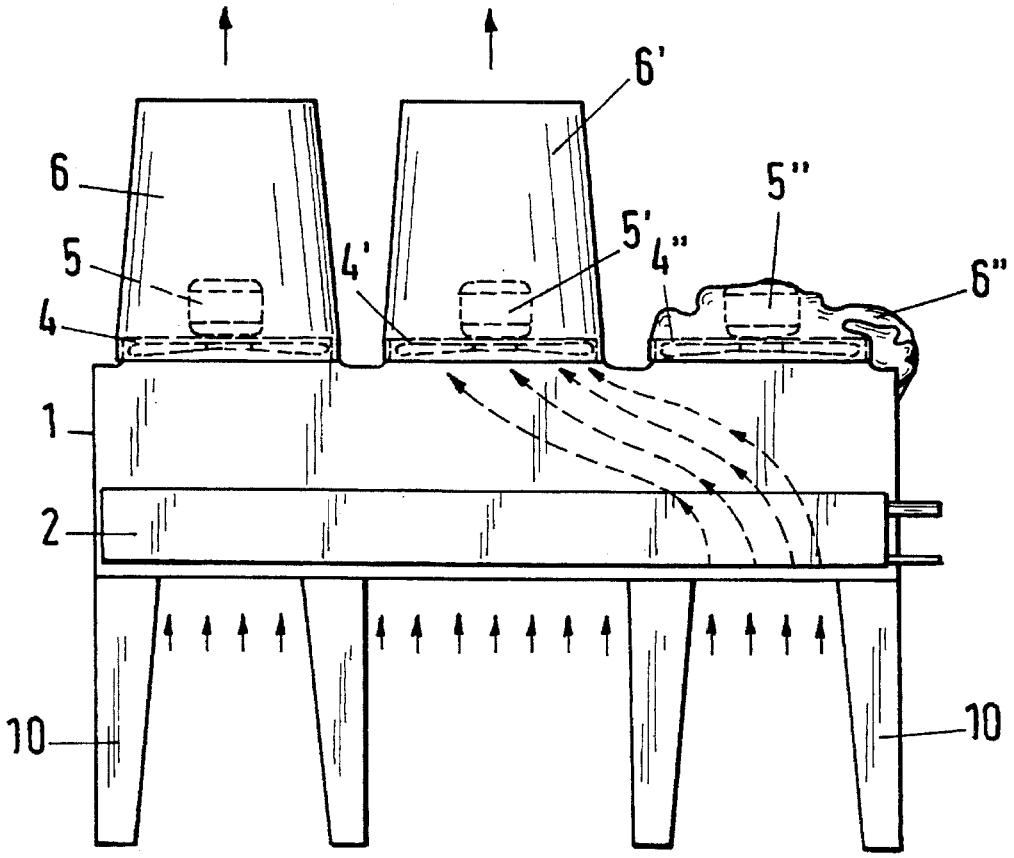
FIG. 4 is a view of an air-cooled heat exchanger which is arranged on support posts and has three ventilators.

FIG. 4 shows the horizontal arrangement of a heat exchanger 2 in the form of a condenser which is supported with its surrounding housing 1 on support posts 10. The air inlet side which is located on the bottom, as indicated by arrows, is open while on the upper side of the housing, which is otherwise closed, there are provided three air outlet openings 4, 4', 4" which are arranged alongside each other and in each of which there is provided a ventilator 5. A flexible piece of tubing 6, 6' and 6" is attached on the outside of each air outlet opening 4. In the embodiment shown, the two ventilators 5 and 5' are in operation as a result of which the associated pieces of tubing 6, 6' extend upward in the shape of a tube while the piece of tubing 6" on the ventilator 5" which is not operating due to a defect or which has been shut off, has collapsed by the action of gravity and covers the air outlet opening 4". Also in this case, a disadvantageous secondary air flow, which is shown in FIG. 3 and is substantially equivalent to an air short circuit, is prevented since a large part of the air drawn in by the operating ventilators is drawn in via the air outlet opening 4" which is not covered.

In inflated condition, the pieces of tubing may have a cylindrical shape so that the area of the air inlet is equal to that of the air outlet. In inflated condition, however, the pieces of tubing are advantageously of frustoconical shape or have the shape of a truncated pyramid, as indicated in FIG. 4, so that the cross section on the outer side is somewhat less than on the inner side which rests against the housing. This favours the collapsing of the pieces of tubing when the ventilator is shut off.

Due to the shape of the piece of tubing 6 which tapers towards the outside, a slight dynamic pressure is produced upon operation of the ventilator, which pressure excludes constant movement of the tubing. When the dynamic pressure is eliminated upon the shutting off of the ventilator, the piece of tubing drops over the outlet opening and reliably closes off the latter.

Upon completion of a defrosting process, a control device first of all reconnects the cooling process in the heat exchanger and then the ventilator which then eliminates the previously existing closing off of the outlet opening by the piece of tubing.

Figure 5:
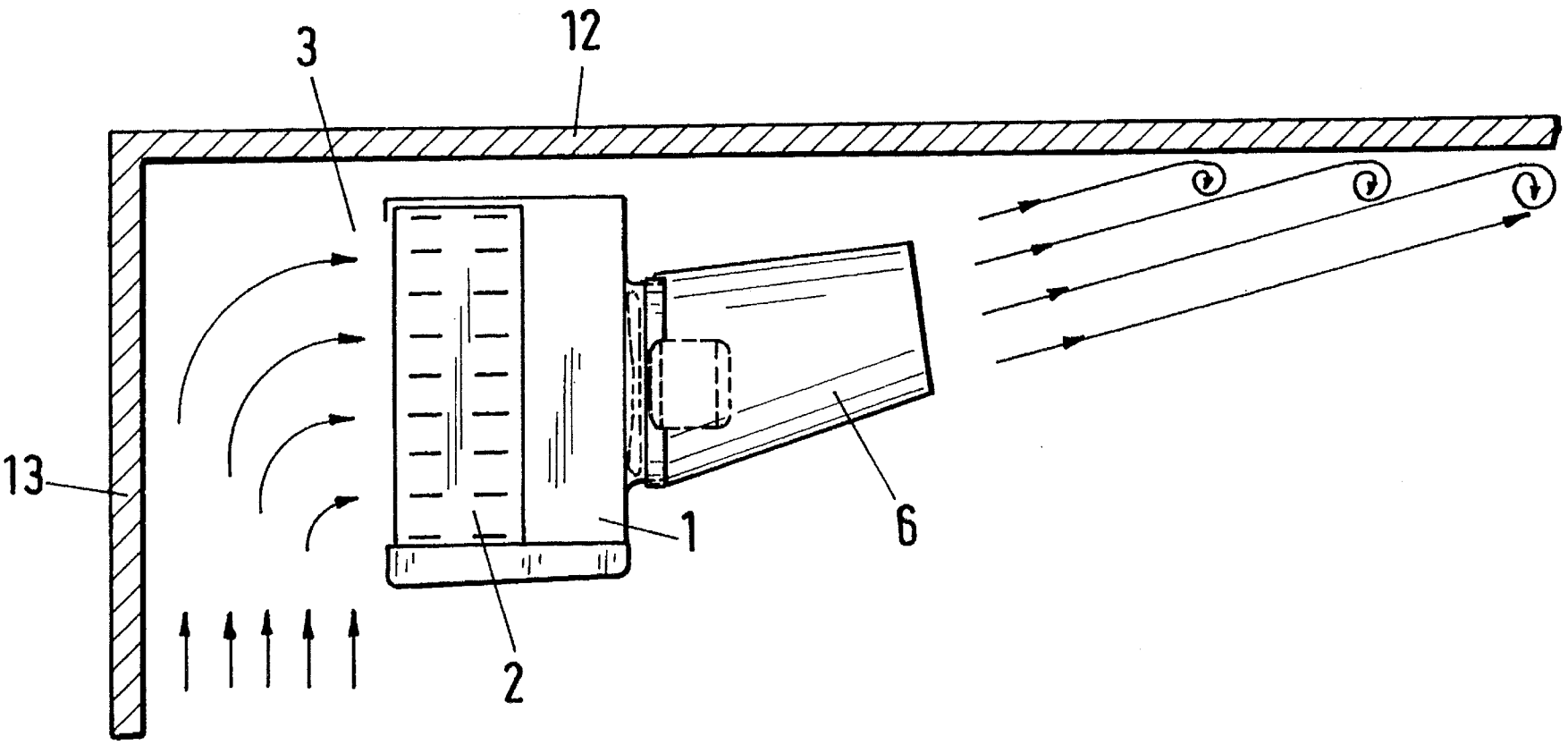
FIG. 5 shows the arrangement of an air cooler close to the ceiling of a room to be cooled.

FIG. 5 shows the arrangement of an air cooler close to the ceiling 12 of a room, the open air inlet side 3 of the housing 1 being arranged in front of the vertical wall 13 of the room. As indicated by arrows, the air flows from the bottom upward along the vertical wall 13 and is deflected horizontally into the heat exchanger 2.

On the air outlet side, there is provided in the embodiment according to FIG. 5 a piece of tubing 6 which extends obliquely upward in inflated condition and through which the cooling air is blown obliquely against the ceiling 12 of the room. This results in an improvement of the cooling air circulation in the refrigerated room whereby draft phenomena are avoided in the refrigerated room.

The flexible piece of tubing provided in accordance with the invention consists preferably of an air-tight and water-repellent material of sufficient heat resistance, for instance of plastic sheeting or a correspondingly coated fabric which does not exhibit great stiffness so that, when the ventilator is shut off, the tubing collapses and covers the air outlet opening.

The hood 7 can consist of galvanized or plastic-laminated aluminium or steel sheet and it may be of any shape, it being open on the bottom in the direction towards the air inlet side of the air cooler and being otherwise closed on all sides. The hood 7 is advisedly provided with heat insulation. The cross sections of hood and piece of tubing are so dimensioned that the air throughput is not impaired during the cooling.

The above-described device can be manufactured and installed in very cost-favourable manner. It is not subject to wear, and it results in considerable advantages due to the fact that, during defrosting, heat losses are avoided which are produced by emerging defrosting air. Furthermore, the defrosting itself is accelerated and no longer impaired by secondary air flows.

Within an air cooler which is to be defrosted, the defrosting output generated can be distributed better by the above-described development if several ventilators are provided alongside each other. Furthermore, there is the advantage that it can be readily determined by means of the inflated piece of tubing whether a ventilator is operating or not.

Due to the flexible pieces of tubing provided on the air outlet openings of the air coolers, there is also achieved a straightening and accelerating of the air flow in the individual ventilators which also results in a greater range of the individual air flows. Due to the straightening of the air flow, a better distribution of the cooling air can be achieved within the room to be cooled.

The flexible covering on the air outlet side is—as shown—advantageously developed as a piece of tubing. It is, however, also possible to provide a curtain consisting of a fabric or sheeting which is, for instance, attached to the upper edge of the outlet opening and which covers the outlet opening in the absence of dynamic pressure and lifts off from the outlet opening when the ventilator is operating. Such a curtain may also have the shape of a hood, for instance similar to one-half of a tube, a piece of tubing being cut open in axial direction and only one-half of the tubing being used as a cover.

Figure 6:
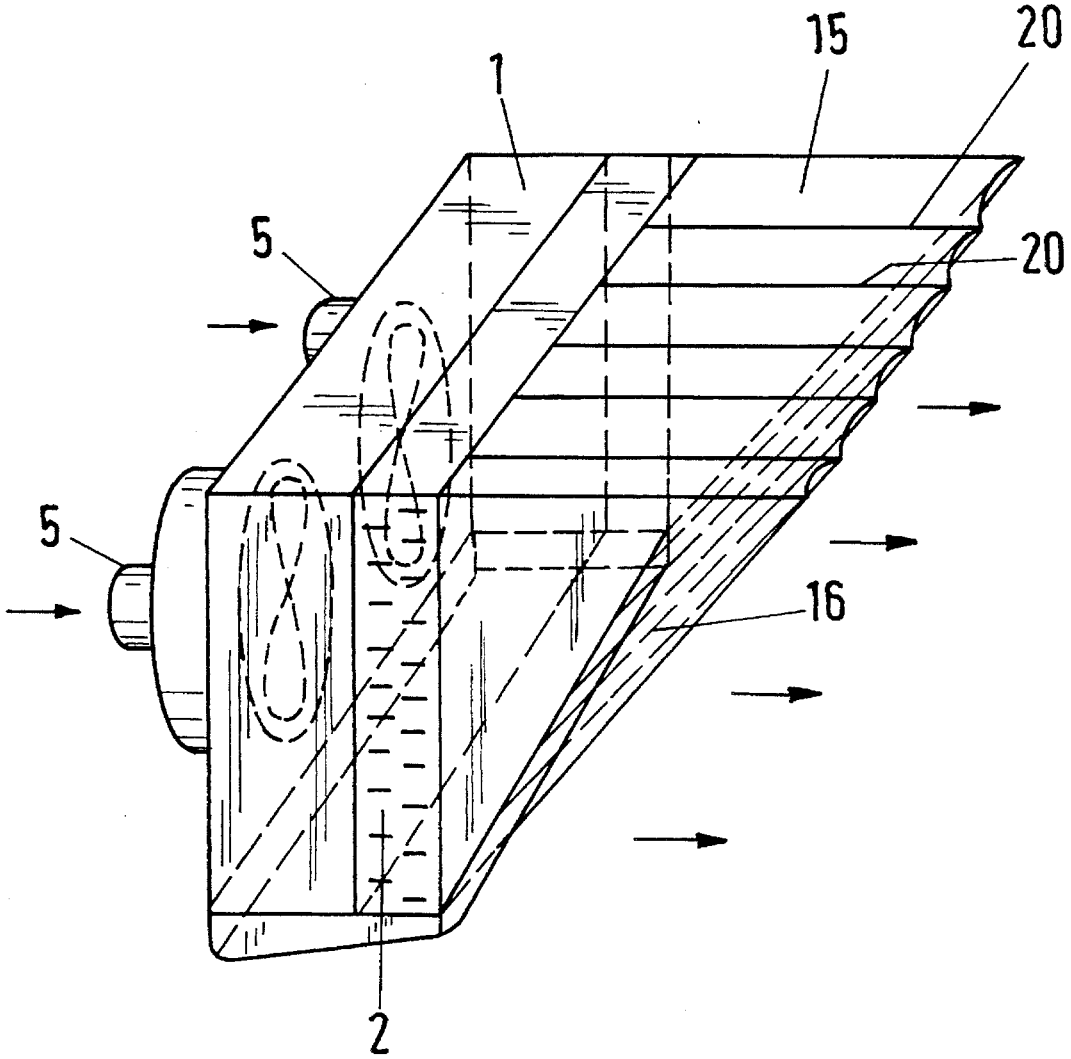
FIG. 6 is a perspective view of another embodiment.

In the case of a rectangular outlet opening 4 of a heat exchanger 2, FIG. 6 shows such a curtain 15 consisting of a flexible piece of material, for instance a coated fabric or plastic sheeting. This flat piece 15 is rectangular corresponding to the dimensions of the outlet opening 4 and is attached to the upper edge of the outlet opening. In order for this flexible flat piece not to-flutter during the operation of the ventilator 5 and thus wear out too soon, the free end of the flat piece 15 is connected by threads 16 or a flexible net to the bottom side of the outlet opening, said threads 16 forming a tensioning device, as shown in FIG. 6, when the flexible flat piece 15 extends in approximately horizontal direction due to the air flow indicated by the arrows. When the ventilator 5 is shut off, the flat piece 15 drops down and covers the outlet opening 4 while the flexible tensioning device 16 also collapses. In FIG. 6, the reference numeral 20 designates seams which subdivide the flat piece 15 into curved sections which impart to said flat piece a better inherent stability.

Figure 7:
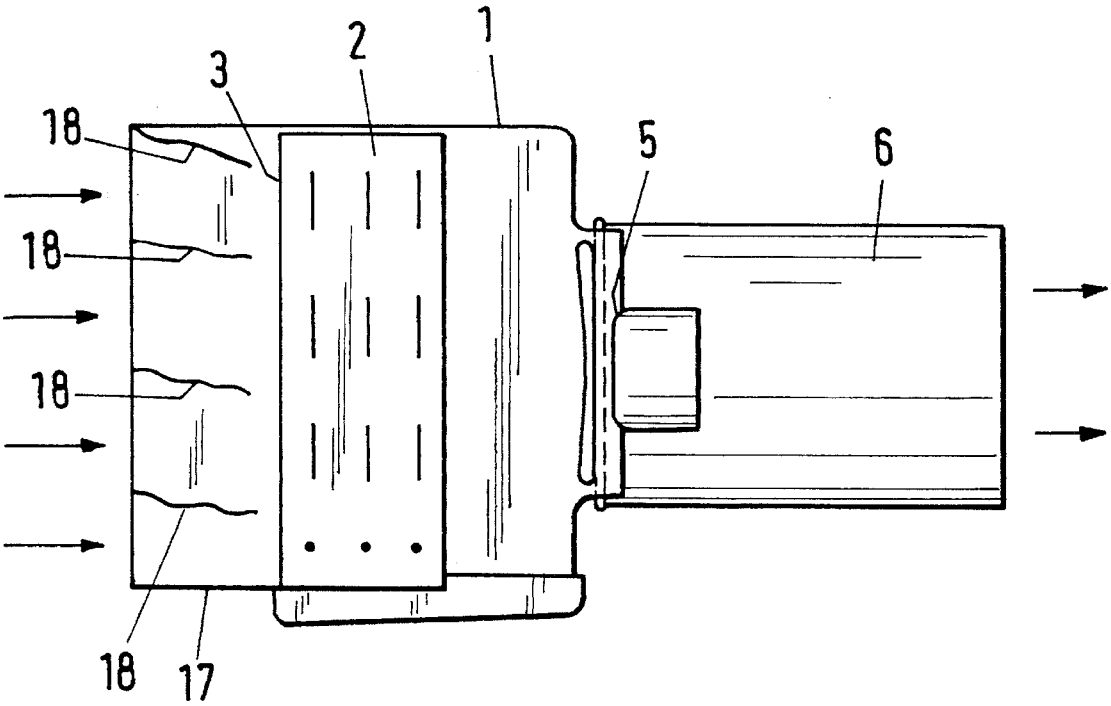
FIG. 7 is a side view of a modified embodiment of FIG. 2.

Instead of the rigid hood 7 of FIG. 2, in the embodiment according to FIG. 7, a rigid duct piece 17 is arranged in front of the, for instance, rectangular air inlet opening 3 of the heat exchanger 2, strips 18 of flexible material such as fabric, sheeting or the like being so arranged distributed over the height of said duct piece 17 that said strips 18, when the ventilator 5 is shut off, hang downward and cover the inlet opening. When the ventilator 5, which is arranged in the outlet opening, draws in air, these flexible strips 18 are aligned in the direction of flow of the air whereby they expose the inlet cross section as shown in FIG. 7. This development has the same effect as the hood 7 in FIG. 2.

Figure 8:
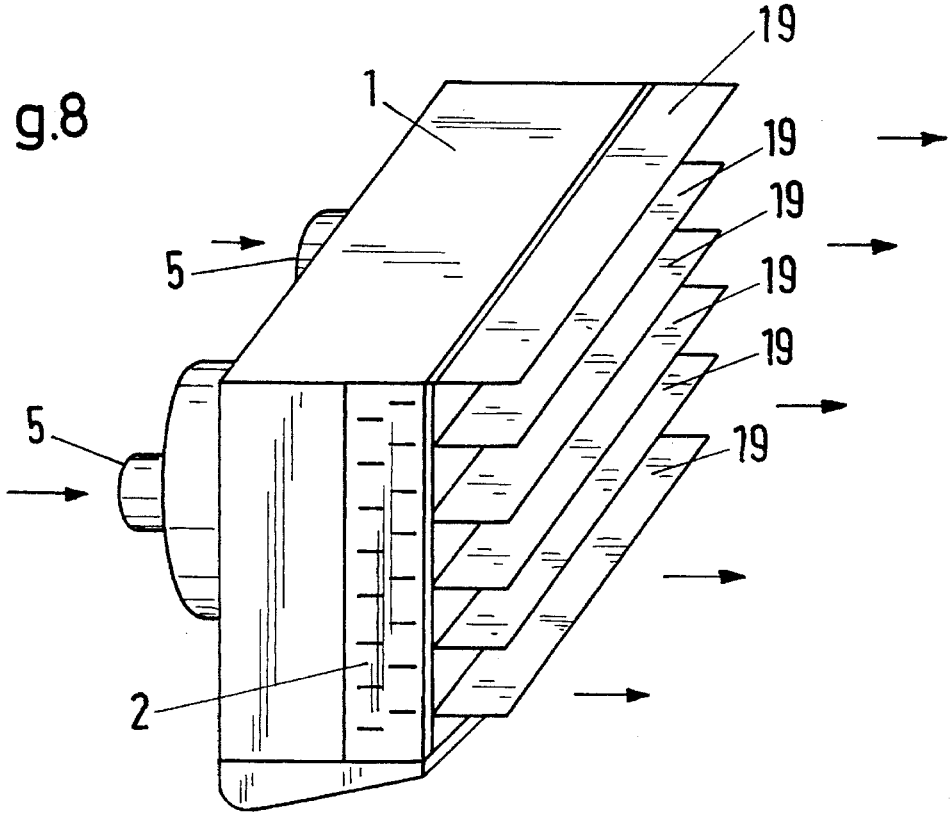
FIG. 8 shows another embodiment.
Figure 1:
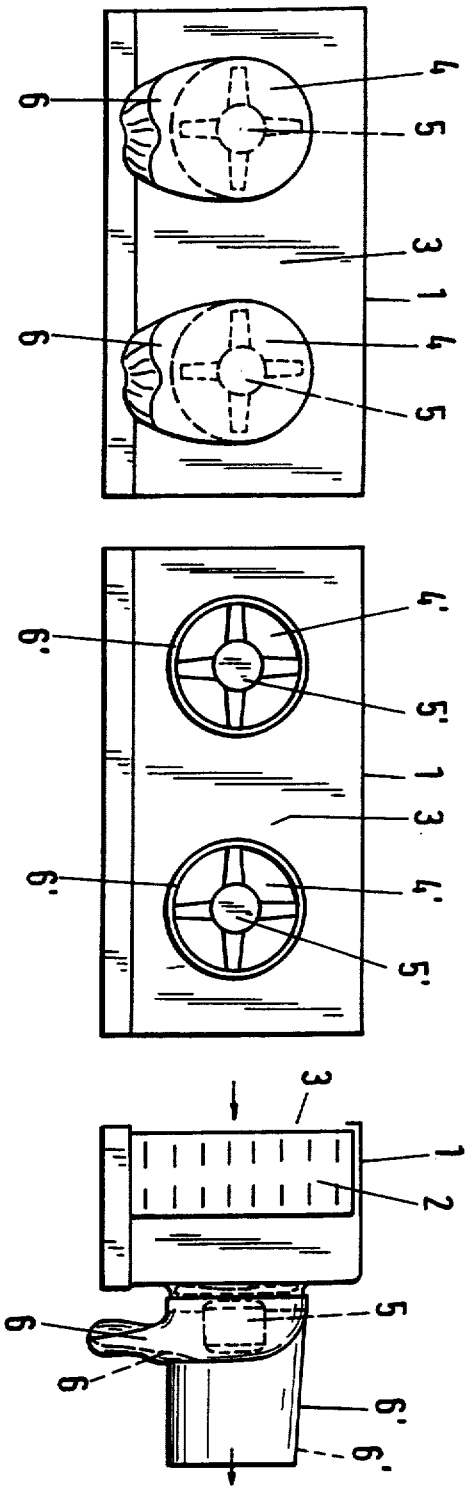

In corresponding manner, and in particular in the case of a rectangular air outlet opening 4, strips 19 of flexible material can be arranged one above the other in such a manner that they cover the outlet opening 4 when the ventilator is shut off, it being also possible for the individual strips 19 to overlap while during operation of the ventilator 5 the strips 19 are aligned in the direction of flow of the air and expose the outlet opening as shown in FIG. 8. Due to the small width of said strips 19, a flexible tensioning device 16 can be dispensed with since the narrow strips do not flutter as strongly in the direction of flow of the air as a longer flat piece 15 shown in FIG. 6.

I claim:

1. A heat exchanger comprising:

a housing having an inlet opening and an outlet opening, one or more ventilators attached to said housing for creating an air flow through said heat exchanger from said inlet opening to said outlet opening, one or more pieces of flexible material, said flexible material being attached around the perimeter of said outlet opening, wherein said flexible material is capable of aligning itself in the direction of said air flow upon operation of said ventilator to have a tubular shape which tapers in the direction of said air flow, and wherein said flexible material collapses and covers said outlet opening when said ventilator is shut off.

2. Heat exchanger according to claim 1, further comprising a rigid hood covering said inlet opening of said housing, said hood having an opening open on the bottom thereof to allow air to enter said inlet opening.

3. Heat exchanger according to claim 2, wherein several ventilators are arranged alongside each other, and said hood further comprises partition walls arranged between said ventilators.

* * * * *

UNITED STATES PATENT AND TRADEMARK OFFICE

CERTIFICATE OF CORRECTION

PATENT NO. : 5,538,074

DATED : July 23, 1996

INVENTOR(S) : Friedhelm Meyer

It is certified that error appears in the above-identified patent and that said Letters Patent is hereby corrected as shown below:

The drawing sheet 1 of 6, should be deleted to be replaced with the drawing sheet, consisting of Fig. 1, as shown on the attached page.

Signed and Sealed this

Fifth Day of November, 1996

Bruce Lehman

*Attest:*

BRUCE LEHMAN

*Attesting Officer*

*Commissioner of Patents and Trademarks*